United States Patent [19]

Lorenson et al.

[11] Patent Number: 4,990,735

[45] Date of Patent: Feb. 5, 1991

[54] IMPROVED UNIFORMITY OF MICROWAVE HEATING BY CONTROL OF THE DEPTH OF A LOAD IN A CONTAINER

[75] Inventors: Claude P. Lorenson; Bryan C. Hewitt, both of Kingston; Richard Keefer, Peterborough; Melville D. Ball, Kingston, all of Canada

[73] Assignee: Alcan International Limited, Montreal, Canada

[21] Appl. No.: 359,589

[22] Filed: Jun. 1, 1989

[30] Foreign Application Priority Data

Feb. 13, 1989 [CA] Canada ..... 590860

[51] Int. Cl.[5] ..... H05B 6/80

[52] U.S. Cl. ..... 219/10.55 E; 219/10.55 F; 219/10.55 M; 426/107; 426/234; 426/243; 99/DIG. 14

[58] Field of Search ..... 219/10.55 E, 10.55 F, 219/10.55 M, 10.55 R; 426/107, 113, 241, 243, 234; 99/DIG. 14, 451; 126/390

[56] References Cited

U.S. PATENT DOCUMENTS

| | | | |
|---|---|---|---|
| 2,714,070 | 7/1955 | Welch | 219/10.55 E |
| 4,133,896 | 1/1979 | Standing et al. | 219/10.55 E |
| 4,703,149 | 10/1987 | Sugisawa et al. | 219/10.55 E |
| 4,816,634 | 3/1989 | Lentz et al. | 219/10.55 M |
| 4,841,112 | 6/1989 | Peleg | 219/10.55 F |

FOREIGN PATENT DOCUMENTS

| | | |
|---|---|---|
| 1239999 | 8/1988 | Canada . |
| 87304120.6 | 11/1987 | European Pat. Off. . |

OTHER PUBLICATIONS

"Aluminum Foil Containers for Microwave Oven Use", International Microwave Power Institute, 19th Annual Meeting, pp. 8–12, Sep. 1984.

Roebuck et al., "Dielectric Properties of Carbohydrate-Water Mixtures at Microwave Frequencies", Journal of Food Science, vol. 37 (1972), pp. 199–204.

Keefer—"The Modelling of Foods as Resonators, in Predicting Microwave Heating Performance"—22nd Annual Microwave Symposium of the International Microwave Power Institute in Cincinnati, Ohio–Hyatt Regency Hotel—Aug. 31'Sep. 2, 1987.

Ball et al.—"Factors Relating to the Performance of Thin Metallized (Susceptor) Films in the Microwave Oven"—23rd Annual Microwave Symposium of the International Microwave Power Institute in Ottawa, Ontario, Canada—Skyline Hotel—Aug. 29–Aug. 31, 1988.

*Primary Examiner*—Philip H. Leung

[57] ABSTRACT

A product comprises a shallow container and a load located therein for heating by microwave energy. This product is designed either to be used with, or itself to incorporate, a structure for generating or enhancing at least one mode of the microwave energy of an order higher than a fundamental mode that is determined by boundary conditions resulting from the lateral dimensions of either the container of the load or both. The invention resides in controlling the depth of the load in the container in such a manner that, upon irradiation of the product with the microwave energy, the power absorbed by the load from a higher order mode is at or near a maximum value, while preferably the power absorbed by the load from the fundamental mode is at or near a minimum value. Since uneven heating would ordinarily be associated with the predominance of a fundamental mode, the result of this invention is to increase the intensity of a higher order mode relative to the fundamental mode intensity, and thus provide improved microwave heating uniformity.

24 Claims, 8 Drawing Sheets

UNIFORMITY OF MICROWAVE HEATING BY CONTROL OF THE DEPTH OF A LOAD IN A CONTAINER

FIELD OF THE INVENTION

This invention relates to improvements in microwave heating, and, more particularly, to means and method for modifying a field of microwave energy in a load in a microwave oven, the load being a substance or article to be heated by the microwave energy. The substance or article will usually be a foodstuff, but the invention is applicable to other substances. Such field modification is for the purpose of generating (or enhancing the existence of) one or more higher order modes of microwave energy in the load.

BACKGROUND OF THE INVENTION

The purpose of generating (or enhancing) the higher order modes is to distribute the energy more evenly throughout the load, and, in particular, to avoid, or at least reduce the occurrence, of uneven temperatures in the load, especially the presence of cold spots at certain locations in the load, usually the center.

The term "mode" is used in the specification and claims in its art-recognized sense, as meaning one of several states of electromagnetic wave oscillation that may be sustained in a given resonant system at a fixed frequency, each such state or type of vibration (i.e. each mode) being characterised by its own particular electric and magnetic field configurations or patterns. The fundamental modes of a body of material to be heated, or of such body and a container in which it is located, are characterised by an electric field pattern (power distribution) typically concentrated around the edge (as viewed in a horizontal plane) of the body of the substance to be heated, or around the periphery of its container when the substance is enclosed by and fills a container, these fundamental modes predominating in a system that does not include any higher order mode generating means. The fundamental modes are thus defined either by the geometry of the container or by the geometry of the body of material to be heated, or to varying degrees by both geometries.

A mode of a higher order than that of the fundamental modes is a mode for which the electric field pattern (again, for convenience of description, considered as viewed in a horizontal plane) corresponds to each of a repeating series of areas smaller than that circumscribed by the electric field pattern of the fundamental modes. Each such electric field pattern may be visualized, with some simplification but nevertheless usefully, as having maxima distributed about a closed loop in the horizontal plane.

The generation or enhancement of such higher order modes can provide more control over the heating of different regions of the substance, and, in particular, render the heating more uniform throughout the substance being heated, compared with the result that would be obtained from the fundamental modes alone.

PRIOR ART

Methods of generating or enhancing such higher order modes are known. Richard M. Keefer Canadian Patent No. 1,239,999 issued Aug. 2, 1988. (U.S. Pat. No. 4,866,234 issued Sept. 12, 1989 and European Patent Application No. 86304880 filed June 24, 1986 and published Dec. 30, 1986) discloses the achievement of this objective by providing in a part of a container in which the substance to be heated is supported, e.g. in the bottom or lid of the container, or in both, an array of one or more conducting plates distributed across a microwave-transparent substrate.

Other methods of generating or enhancing higher order modes are disclosed in Richard M. Keefer's Canadian Patent Applications Serial No. 508,812 filed May 9, 1986 and 544,007 filed Aug. 7, 1987 (U.S. Pat. No. 4,831,224 issued May 16, 1989 and application Ser. No. 943,563 filed Dec. 18, 1986 and European Patent Application No. 87304120.6 filed May 8, 1987 and published Nov. 19, 1987 under No. 0246041). In particular, this disclosure shows that the generation or enhancement of higher order modes can be achieved by stepped structures that protrude into or out of the container from a surface thereof, usually a bottom surface, or by a dielectric wall structure that comprises at least two wall portions of respectively different electrical thicknesses, i.e. different spatial thicknesses or different dielectric constants.

When microwave energy is applied to a load mounted in a container made of metal, but with a microwave-transparent lid (or after the lid has been removed), the energy all enters the load through the top surface. If only the fundamental modes were present, the field would be such that the edge regions of the load would be heated to a higher temperature than the central region. In the case of a container in which the side wall or walls are made of a microwave-transparent or semi-microwave-transparent material, some of the energy also reaches the load through such side walls. This still further heats the edge regions of the load and hence aggravates the lack of uniformity of heating among the edge and central regions.

It is primarily to counteract this nonuniformity of heating (energy absorption) that the various methods of generating or enhancing higher order modes mentioned above have been developed.

SUMMARY OF THE INVENTION

The present invention is directed to providing additional compensation for such lack of uniformity. While the present invention is applicable to all containers, including those having metallic (reflective) side walls, it is especially suited to use with containers that either have no side wall structure at all or have a side wall structure that is at least partially microwave-transparent, i.e. fully microwave-transparent or semi-microwave-transparent, because of the higher inherent nonuniformity of heating that such containers tend to exhibit.

As indicated above, prior to the present invention, the proposals for minimising the nonuniformity of energy absorption among regions of the load have concentrated on generating (or enhancing) higher order modes of microwave energy by selection of the shapes and dimensions of a container or various structures mounted in a container or on a separate member.

While such stimulation of higher order modes has helped to some extent in practice towards improving heating uniformity, there has been a continued presence of the fundamental modes simultaneously with the higher order modes. The improvement in heating uniformity resulting from the generation of higher order modes would be further enhanced if it were possible to increase the intensity of the higher order modes relative to the fundamental modes.

It has now been discovered that this objective can be achieved by proper control of the depth dimension of the load itself.

More specifically, it has been found possible by such control to ensure that the power absorbed by the load from a higher order mode is substantially at or at least near a maximum value relative to the fundamental mode. Preferably, the depth control is also such as simultaneously to arrange for the power absorbed by the load from the fundamental mode to be less than that absorbed by the load from the higher order mode and indeed for such power absorbed from the fundamental mode to be at or near a minimum value.

Thus, the invention consists of a product comprising a container and a load located therein or thereon for heating by microwave energy, said product being for use with means for generating at least one mode of said energy of an order higher than a fundamental mode determined by boundary conditions defined by lateral dimensions of at least one of said container and said load, wherein the depth of the load in the container is such that, upon irradiation of the product with microwave energy, the power absorbed by the load from said higher order mode is at or near a maximum value.

The invention also consists of an assembly comprising (a) a container for mounting a load in a microwave oven, for use with means for generating at least one mode of microwave energy of an order higher than a fundamental mode determined by boundary conditions defined by lateral dimensions of at least one of said container and said load, and (b) means for indicating a depth of the load in the container such that the power absorbed by the load from said higher order mode will be at or near a maximum value.

The invention also provides a method of heating a load in a container by microwave energy, lateral dimensions of at least one of said container and said load defining boundary conditions that determine a fundamental mode of said energy, said method comprising the steps of (a) generating at least one mode of said energy of an order higher than said fundamental mode, and (b) so controlling the depth of said load that the power absorbed by the load from said higher order mode is at or near a maximum value relative to the fundamental mode.

DETAILED DESCRIPTION OF THE PREFERRED EMBODIMENTS

In accordance with the present invention, selection of the depth of the load creates a condition in which the ratio of the energy existing as the higher order mode (or modes) to the energy present in the fundamental mode (or modes) is maximized, or is at least increased over the value that it would have in the absence of such depth control.

FIGS. 1A, 1B, 1C and 1D show top plan views of containers of circular, elliptical, rectangular and complex geometry, respectively. Corresponding to each of these views are the cross-sectional views taken across lines *2a—2a, 2b—2b, 2c—2c* and *2d—2d,* all represented by FIG. 2. Each of the containers 11*a,* 11*b,* 11*c* and 11*d* is comprised of a base portion 12 and sidewall portion 13 enclosing a microwave energy absorptive load 10. If the load 10 is a solid or semi-solid article or assemblage of articles, the sidewall 13 may not be necessary for containment of the load, and therefore may optionally be omitted, in which event the containers 11*a,* 11*b,* 11*c* and 11*d* will be understood to consist essentially of a sheet or plate bottom portion 12.

Hence the term "container" as used herein (including the claims) includes a simple support for the load without necessarily having a restraining sidewall structure.

Figure 1A:
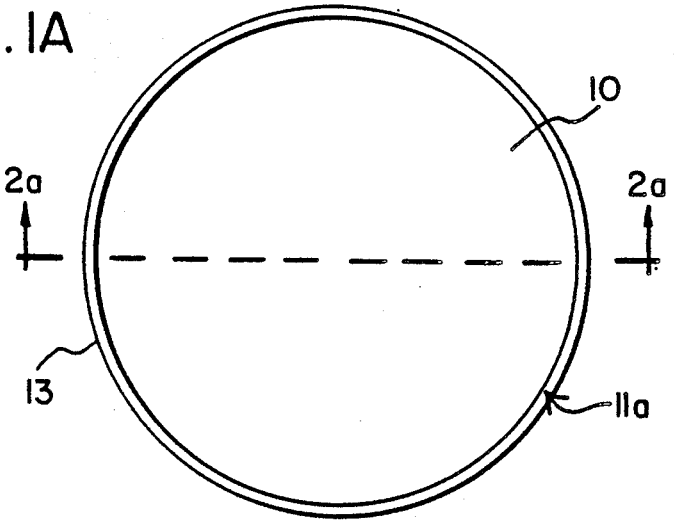
FIG. 1A is a top plan view of a product consisting of a circular container with a load therein, for heating in a microwave oven.
Figure 2:
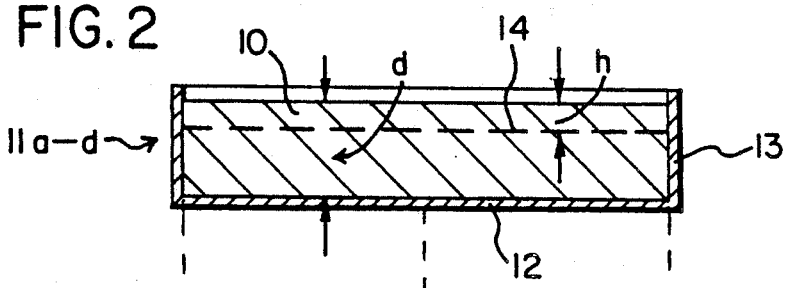
FIG. 2 is a cross-section on each of lines *2a—2a; 2b—2b; 2c—2c;* and *2d—2d* in FIGS. 1A-1D.
Figure 1B:
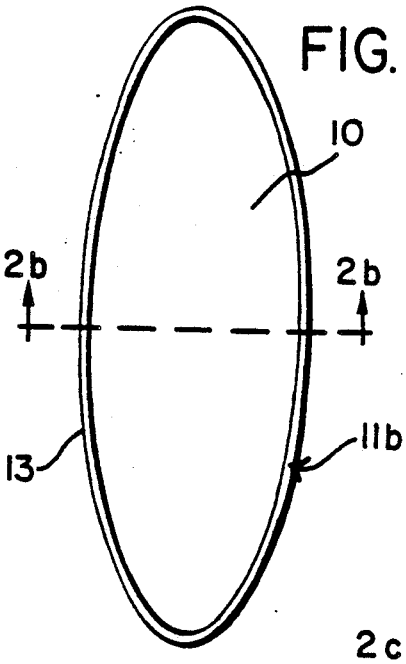
FIG. 1B is a similar view of a container with elliptical geometry.

The container 11*a* of circular geometry shown in FIGS. 1A and 2 is also representative of containers of nearly circular plan; that is, a container having a small departure from circularity in plan will behave essentially as a circular container for the purpose of this invention. Likewise, the container 11*b* of elliptical plan shown in FIGS. 1B and 2 is for the purpose of this invention representative of elliptical containers of greater or lesser eccentricity than that shown, and also of containers whose plan approximates to the elliptical. Recognizing that a circle is merely an ellipse of zero eccentricity, the circular container 11*a* may be regarded notionally as belonging to the more general family of elliptical containers. While a theoretical structure with an eccentricity of exactly unity must have zero volume, containers having nearly unity eccentricity will assume a rod-like plan suitable for the heating of elongated loads. Thus, at a ratio of elliptical major-axis to minor-axis lengths of as low as 5, the corresponding eccentricity will approach 0.98, and at a ratio of 10, the eccentricity will exceed 0.99. Elliptical containers may therefore be defined as having eccentricities within the range of just less than unity, and greater than or nearly zero.

Figure 1C:
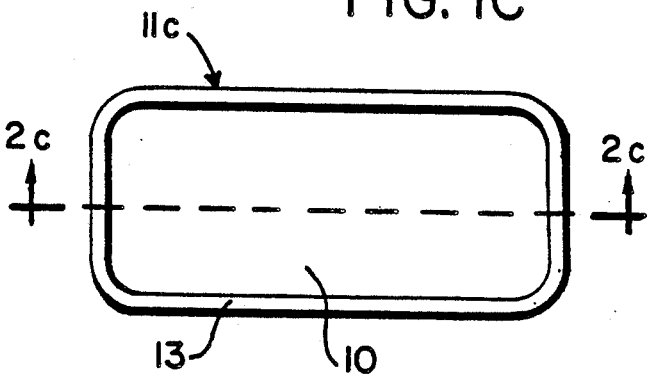
FIG. 1C is a similar view of a container with rectangular geometry.

Similarly, the container 11*c* of rectangular plan shown in FIGS. 1C and 2 is for the purpose of this invention representative of square containers and of containers of greater or lesser aspect ratio, and also of containers whose plan approximates to the rectangular (e.g. rectangular, but with rounded corners).

Figure 1D:
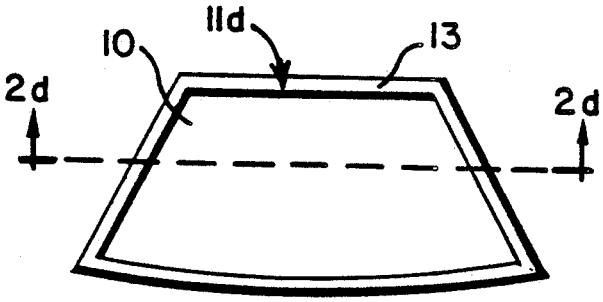
FIG. 1D is a similar view of a container with complex geometry.

The container lid of complex geometry depicted in FIGS. 1D and 2 is representative of container plan geometries not readily describable as belonging to the families of circular, elliptical, and rectangular container geometries as hereinabove set out. The container plan geometries herein referred to as complex may also include, without limitation, triangular, trapezoidal (of which rectangular and square plans are special cases), pentagonal, hexagonal, and other polygonal geometries, rounded polygonal geometries, and epitrochoidal, multifoil (e.g. trefoil) and other lobed geometries. Hence, the plan view of the container 11*d* is intended to be broadly representative of these and other geometries in showing that the present invention is not specific to a particular container plan geometry.

FIGS. 3–8 serve to demonstrate graphically the problems of nonuniformity of heating of a load 10 to be heated by microwave energy in containers of circular elliptical, rectangular or complex (as hereinbefore defined) plan geometry.

Microwave heating of the load, also referred to as its power absorption, can be described by the relation:

$$\rho=\tfrac{1}{2}[\sigma_e(\vec{E}\cdot\vec{E}^*)+\sigma_m(\vec{H}\cdot\vec{H}^*)]$$

In this relation, the power absorption P is expressed in units of watts per cubic meter. The term $\sigma_e$ is the conductivity of the load, in units of coulomb per (volt meter second) or (coulomb)$^2$ per (joule meter second). In the absence of electrical conduction by the load, $\sigma_e$ will have the value $2\pi\cdot f\cdot\epsilon''\cdot\epsilon_o$, where f is the microwave oven operating frequency, $\epsilon''$ is the complex part of the relative dielectric constant giving rise to dielectric losses, and $\epsilon_o$ is the free-space (electric) permittivity, having a value of nearly $8.8541878\cdot10^{-12}$ expressed in coulomb per (volt meter) or (coulomb)$^2$ per (joule·meter). The vector $\vec{E}$ describes the electric field intensity, in units of volt per meter or joule per (coulomb·meter), and $\vec{E}$ is its complex conjugate. The vectorial dot product $\vec{E}\cdot\vec{E}^*$ may be expressed as the vectorial square magnitude $|E|^2$.

The term $\sigma_m$ gives rise to magnetic losses, and is expressed in units of (joule·second) per (meter·(coulomb)$^2$). The vector $\vec{H}$ is the magnetic field intensity, in units of coulomb per (meter second), $\vec{H}^*$ is its complex conjugate, and the vector dot product $\vec{H}\cdot\vec{H}^*$ is equivalent to the squared magnitude $|H|^2$.

For such non-magnetic loads as foods, the term $\sigma_m$ will have a value approaching zero, so that the contribution of the magnetic field to power absorption may then be ignored. For these loads, power absorption may be taken as essentially proportional to $|E|^2$, or it may be described by the expression:

$$P=\pi\cdot f\cdot\epsilon''\cdot\epsilon_o\cdot|E|^2.$$

The vector $\vec{E}$ from which $|E|^2$ is obtained can be represented in the generalized form:

$$\vec{E}=E_u\cdot\hat{u}+E_v\hat{v}+E_z\hat{z}$$

where $\hat{u}$, $\hat{v}$ and $\hat{z}$ are unit vectors parallel to the corresponding axes making up the coordinate system. The magnitude of these vectors is 1.

The unit vectors u and v are directed in the horizontal plane 14 of the load parallel to the container plan views of FIGS. 1A, 1B, 1C and 1D, and the unit vector z is orthogonal to this plane. For the circular, elliptical and rectangular container geometries of FIGS. 1A, 1B and 1C, the horizontal plane unit vectors u and v may be listed in the more familiar notation:

| | Horizontal Plane | | | |
|---|---|---|---|---|
| | Unit Vectors | | Coordinates | |
| Container Geometry | u | v | u | v |
| Circular | $\rho$ | $\phi$ | $\rho$ | $\phi$ |
| Elliptical | $\xi$ | $\eta$ | $\xi$ | $\eta$ |
| Rectangular | $\chi$ | $\gamma$ | $\chi$ | $\gamma$ |

The $\rho$ and $\sigma$ coordinates of the circular geometry are radial and angular, and the $\hat{\rho}$ and $\hat{\Phi}$ unit vectors designate radial and angular components, respectively. The unit vector $\hat{\rho}$ is directed normally to the sidewall 13 of the circular container 11*a* and the vector $\hat{\Phi}$ is directed tangentially to this sidewall. Unit vector $\hat{\xi}$ is directed normally to sidewall 13 of elliptical container 11*b* and vector $\hat{\eta}$ is directed tangentially to the sidewall. The x and y coordinates of the rectangular geometry are parallel to the flat sidewall portions of a rectangular container, and the unit vectors $\hat{x}$ and $\hat{y}$ are parallel to the corresponding x and y axes, respectively. Unit vector $\hat{x}$ is directed normally to the sidewall parallel with the y-axis, and tangentially to the sidewall parallel with the x-axis; y is directed normally to the sidewall parallel with the x-axis, and tangentially to the sidewall parallel with the y-axis. The generalized unit vector u is chosen to be directed normally to a region of sidewall 13 of the container 11*d* of complex geometry, and the unit vector v is directed tangentially to the same region of sidewall 13.

If the sidewalls 13 of the containers 11*a*, 11*b*, 11*c* and 11*d* approximate to the vertical, the vertical component of the vector $\vec{E}$ with the unit vector $\hat{z}$ will be orthogonal to the components having unit vectors generalized as $\hat{u}$ and $\hat{v}$, directed in the horizontal plane of the containers. In differential form, Maxwells's equations governing $\vec{E}$ and $\vec{H}$ may be expressed as:

$$\vec{\nabla}\times(\vec{\nabla}\times\vec{E})=4(\pi/\lambda_o)^2\cdot(\epsilon'-j\epsilon'')\cdot\vec{E}$$

$$\vec{\nabla}\times(\vec{\nabla}\times\vec{H})=4(\pi/\lambda_o)^2\cdot(\epsilon'-j\epsilon'')\cdot\vec{H}$$

In these equations, the vectors $(\vec{\nabla}\times\vec{E})$ and $(\vec{\nabla}\times\vec{H})$ may also be written as their equivalents curl E and curl $\vec{H}$. The term $\lambda_o$ is the free-space wavelength (approximately that in air) at the microwave oven operating frequency, $\epsilon'$ is the real part of the relative dielectric constant, and j has the usual value $\sqrt{-1}$. For the circular-cylindrical, elliptical-cylindrical, rectangular or generalized cylindrical coordinate systems describing, respectively, the circular, elliptical, rectangular and complex container geometries, orthogonality of the vertical component of $\vec{E}$ with respect to the $\hat{u}\cdot\hat{v}$ plane allows separation of variables in the solution of Maxwell's equations. Hence, the following relation is obtained:

$$k^2-p^2=4(\pi/\lambda_o)^2\cdot(\epsilon'-j\epsilon'').$$

The terms k and p are separation constants, in units of reciprocal meters. The constant k allows separation of the parts of a solution dependent on the horizontal plane coordinates (generalized as u and v), and p is the separation constant for the parts of the solution dependent on the coordinate z of the vertical axis.

When the sidewalls 13 of the containers 11*a*, 11*b*, 11*c* and 11*d* are strongly reflective (e.g. metallic), the term $\rho_e$ determining power absorption by the load 10 principally affects the vertical parts of the solution, so that k is constrained to be real and p complex. The vertical separation constant p may thus be written as:

$$p=\alpha+j\beta.$$

The terms $\alpha$ and $\beta$ are also in units of reciprocal meters, and are then defined by the relations:

$$\alpha = \sqrt{2}\,(\pi/\lambda_\phi)\cdot[-(\epsilon'-(k\lambda_o/2\pi)^2)+((\epsilon'-(k\lambda_o/2\pi)^2)^2+\epsilon''^2)^{\frac{1}{2}}]^{\frac{1}{2}} \quad (1a)$$

and $$\beta = \sqrt{2}\,(\pi/\lambda_\phi)\cdot[+(\epsilon'-(k\lambda_o/2\pi)^2)+((\epsilon'-(k\lambda_o/2\pi)^2)^2+\epsilon''^2)^{\frac{1}{2}}]^{\frac{1}{2}}$$

The corresponding vertical dependence of the solutions is then essentially proportional to the factor D(z), given by the equation:

$$D(z)=(e^{-pz}\pm\Gamma e^{pz}). \quad (1b)$$

The symbol e is used in its usual sense to denote exponential functions. The coordinate z refers to vertical depth in the load 10 (its upper surface being at z=0), with the first part $e^{-pz}$ describing downward propagation from the upper surface of the load, and the second part $e^{pz}$ referring to propagation upwardly from the lower surface. The upward propagation of this second part may be due to reflections at the container bottom 12, or if the container bottom is at least partially microwave-transparent, a portion of the upwardly propagating energy will result from transmission through the bottom surface (assuming the microwave oven and any utensils used with it are so designed as to supply energy to that surface). The term $\Gamma$ then serves to described multiple reflections occurring between the upper and lower surfaces of the load, which may be expressed as phase shifts. Just as the solution of Maxwell's equations for these containers in $\vec{E}$ and $\vec{H}$ will depend on the vertical part of the solutions determined by the factor D(z), the power adsorption P will be essentially proportional to the square magnitude of this part, through the dependence of P on the squared magnitude $|E|^2$.

From the separation of variables previously discussed, the parts of the solutions dependent upon the horizontal plane coordinates u and v may now be examined, independently of the vertical part of the solution. Since the power adsorption P may be treated as essentially proportional to the squared magnitude of the vertical part, (this vertical part being independent of the coordinates u and v), the power P may also be regarded as essentially proportional to the squared magnitude of the horizontal parts expressed in the variables u and v (independently of the vertical variable z.

In circular, elliptical and rectangular geometries, the vectors $\hat{u}$ and $\hat{v}$ are orthogonal, and the horizontal part with coordinates u and v may be further separated into u- and v-parts (the u-part being independent of the variable v, and vice versa). For these geometries, the power P can therefore be further taken as essentially proportional to the squared magnitude (or square) of each of its u- and v-parts. When u and v are orthogonal, the power P may also be expressed as:

$$P=\tfrac{1}{2}\rho_e[|E_u|^2+|E_v|^2+|E_z|^2].$$

In this expression, each of the components of the power $|E_u|^2$, $|E_v|^2$ and $|E_z|^2$ will also be essentially proportional to its u-, v- and z-parts.

The sidewall portions 13 of the containers 11*a*, 11*b*, 11*c* and 11*d* may be made of metallic, microwave-transparent or semi-microwave-transparent (e.g. suscepting) materials; alternatively, the sidewall may be omitted, in which event the term "sidewall" will be understood to refer to the exterior surface of the load 10. If the sidewall 13 is a good electrical conductor (e.g. metallic or containing a metallic layer), the laws of electromagnetics require that the component of the electric field directed tangentially to the sidewall be small or disappear at the sidewall. Hence, in virtue of the dependence of power P on $|E|^2$, that portion of the power depending on the tangential component of the electric field must also disappear at the sidewall. At a boundary between two dielectrics, the laws of electromagnetics also require that:

$$\epsilon_f'\cdot E_{n,f}=\epsilon_o'\cdot E_{n,o'}$$

hence $$E_{n,f}=(\epsilon_o'/\epsilon_f')\cdot E_{n,o}).$$

The term $\epsilon_f'$ is the relative dielectric constant of the load 10. The relative dielectric constant $\epsilon_o'$ applies to an adjacent portion of a microwave-transparent container or to surrounding air. If the container is thin and made of a material having a low dielectric constant, $\epsilon_o'$ may be taken as approaching the free-space value of unity. The electric field components $E_{n,f}$ and $E_{n,o}$ are directed normally to the surface of the load. For such loads as foods, the relative dielectric constant $\epsilon_f'$ may have values exceeding 70. Consequently, the normal component $E_{n,f}$ will be small in relation to $E_{n,o}$, and will be forced to assume a minimum at the boundary. Accordingly, in containers having microwave-transparent sidewalls 13 (or in which the sidewalls are omitted), the portion of power P depending on the normal component of the electric field will also approach a minimum at the container sidewalls.

Figure 3:
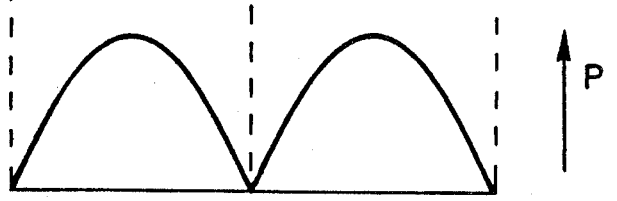
FIGS. 3-8 depict in an idealized way various distributions of power absorption that may exist in the product.
Figure 4:
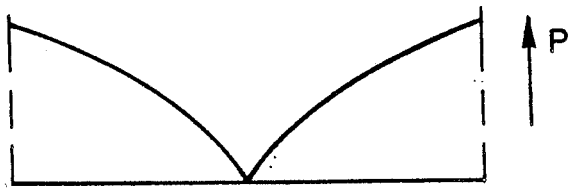

FIGS. 3 and 4 show the variation of the various horizontal plane components of the power P taken at the depth h of plane 14 in FIG. 2. In its minima of power P shown as corresponding to sidewall portions 13, FIG. 3 may be used to describe the variation along lines 2*a*—2*a*, 2*b*—2*b*, 2*c*—2*c* and 2*d*—2*d* of the components of power associated with tangential components of the electric field in a container with electrically conductive walls, or the variation along these lines of the component of power due to the normal component of the electric field in a microwave-transparent container. For a circular container 11*a* as shown in FIG. 1A, the angular and vertical components of the power $|E_\Phi|^2$ and $|E_z|^2$ corresponding to the tangential unit vectors $\hat{\Phi}$ and $\hat{z}$, respectively, will thus disappear at sidewall 13 when the sidewall is metallic (FIG. 3); alternatively, with a microwave-transparent sidewall 13, the radial component $|E_\rho|^2$ corresponding to the unit vector $\rho$ will approach a minimum at the sidewall (FIG. 4). In a complementary manner, the maxima of power shown in FIG. 4 as corresponding to the sidewall portions 13 may be used to describe the variation along lines 2a—2a, 2b—2b, 2c—2c and 2d—2d of the component of power associated with the normal component of the electric field in a container with electrically conductive sidewalls, or the variation along these lines of the components of power due to the tangential components of the electric field in a microwave-transparent container. The curves of power absorption shown in FIGS. 3 and 4 are intended to depict lower order or fundamental modes within a load. Fundamental modes will typically give rise to a concentration of power absorption or heating in regions of the load that are displaced outwardly from the central region, and hence the central region tends to be a cold spot.

Figure 5:
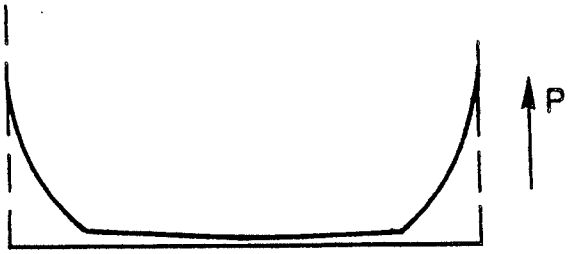
Figure 6:
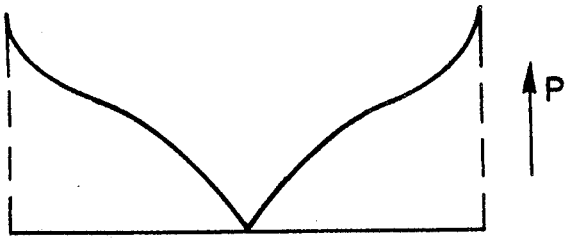
Figure 7:
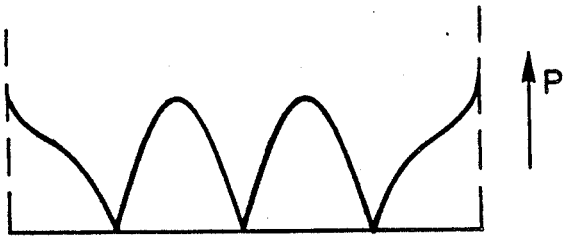
Figure 8:
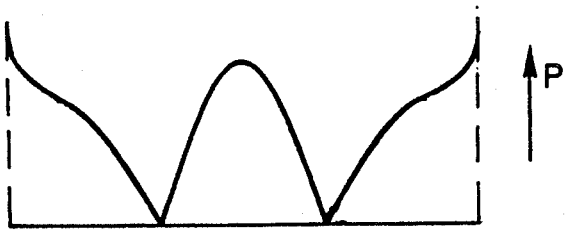

In addition to the power entering the load in a vertical sense, power may also penetrate the edge portions of the load through the sidewalls 13 of microwave-transparent or semi-microwave-transparent containers. FIG. 5 shows a smoothed curve of the variation of this power absorption P along the lines 2a—2a, 2b—2b, 2c—2c and 2d—2d of the various container geometries. In less absorptive loads, this power absorption may also show quasi-periodic variations resembling those of a damped periodic function (as its magnitude). FIG. 6 shows how the additivity of power entering vertically and through the sidewalls of a microwave-transparent or semi-microwave-transparent container causes the low level of relative heating of the central region to become even more pronounced. The power absorption curves of FIGS. 7 and 8 show the effect of higher order modes in yielding maxima of heating that are nearer to each other, which represents a somewhat more uniform distribution of energy. It must be realised that these illustrations depict idealized situations, and that, in practice, the fundamental modes will continue to exist concurrently with the higher order modes in relation to improving heating uniformity.

Recapitulating, the vertical dependence of power absorption by the load was seen to be essentially proportional to the squared magnitude of the factor D(z) given in equation (1b), containing exponential functions of argument $\pm pz$, and with the complex term $p=\alpha+j\beta$. These functions may also be expressed in their equivalent form:

$$e^{\pm pz}=e^{\pm\alpha z}\cdot(\cos\beta z\pm j\sin\beta z).$$

Since the dependence of power absorption on these functions operates through the squared magnitude of the factor D(z), power absorption by the load may be seen to have maxima and minima repeating on a period approximated by:

$$\beta\cdot l_m=\pi,\ \text{whence}\ l_m=\pi/\beta. \qquad (1c)$$

The term $l_m$ may therefore be used to describe the vertical interval separating maxima of power absorption or heating, or between minima. If $\beta$ is in units of reciprocal meters, then $l_m$ will be measured in meters, or if $\beta$ is in reciprocal centimeters or millimeters, $l_m$ will be in centimeters or millimeters, respectively.

Because of the effects described above, it has been found that by varying the value of d (the depth of the load), it becomes possible to promote power minima or power maxima for specific modes. A typical curve for the power P versus depth d, showing such maxima 25 and minima 26 (at intervals $l_m$) for a fundamental mode in a fully microwave-transparent container is depicted in an idealized and not dimensionally accurate form in FIG. 9, while a similar curve with maxima 25' and minima 26' for a typical higher order mode is shown in FIG. 10. The curves for the fundamental mode and for each higher order mode will have different values for the intervals lm and lm'. By locating a value for d, such as the value d', where the fundamental curve is substantially at a minimum 26 while 15 the higher order curve is substantially at a maximum 25', the desirable condition described above can be achieved, namely a high ratio of the energy embodied in the higher order mode to that embodied in the fundamental mode. However, it will not always be possible to select a depth 20 such that a minimum 26 and a maximum 25' will coincide. In such cases the depth should be chosen to achieve the highest possible ratio of energy embodied in the higher order mode to that embodied in the fundamental mode.

Each minimum 26 of the fundamental mode will occur when d is given by $$d=\frac{(2K+1)}{2}\,l_m$$

where K is a positive integer.

To coincide a maximum 25' of the higher order mode with such a fundamental minimum 26, it is necessary to choose a mode that has a value for lm' such that $$d=K'\,l_m'=\frac{(2K+1)}{2}\,l_m \qquad (2)$$

where K' is also a positive integer. In the example shown in FIGS. 9 and 10, K and K' have both been taken as 2.

Hence, in designing a product, i.e. a container and load combination, the first parameter to select will be the most desirable higher order mode. The order of the mode should preferably not be too high, because the higher the order, (a) the more difficult it will be to excite and propagate the mode, and the more complicated the structure to do so;

(b) the greater the likelihood of interference from other modes; and (c) the more severe the cut-off limitation and hence the probability of evanescent propagation.

As indicated above in equation 1(c), theory shows that the value of lm is given by the expression $$l_m=\frac{\pi}{\beta}$$

While the values for lm (and lm') will vary to some extent with the overall size of the container (becoming larger with smaller containers), it has been found that, with a circular container of 10 cm inside diameter and a food load having a typical dielectric constant relative to air ($\epsilon'$) of approximately 60 (determined chiefly by the water constant of the load), and a typical dielectric loss characteristic ($\epsilon''$) of approximately 12, for circular modes wherein $$k=j_{n,m}/r_o$$

where k is the separation constant mentioned above, $j_{n,m}$ is the mth zero of an nth order Bessel function, and $r_o$ is the container radius, the fundamental modes will have the following values of lm:

| | |
|---|---|
| [0, 1] | lm = 0.7919 cm |
| [1, 1] | lm = 0.8009 cm |
| [3/2, 1] | lm = 0.8067 cm |

The latter mode will occur only in a container partitioned into three sections by radial vanes at 120° to each other.

The conventional practice of displaying the mode orders in square brackets has been replaced in the claims by circular brackets to avoid confusion with the Patent Office amendment practice of showing deletions in square brackets.

High order modes in the same circular container will have the following values of lm':

| | |
|---|---|
| [0, 2] | lm' = 0.8177 cm |
| [1, 2] | lm' = 0.8390 cm |
| [3/2, 2] | lm' = 0.8517 cm |
| [0.3] | lm' = 0.8711 cm |
| [1, 3] | lm' = 0.9144 cm |
| [3/2, 3] | lm' = 0.9355 cm |
| [1, 4] | lm' = 1.0479 cm |

If the principal fundamental mode is taken as the [1,1] mode with lm=0.8009 cm, and K is taken as 1, then the right hand term of equation (1) becomes 2½ lm=2.0023 cm.

To obtain a high field strength in the central region of a circular container with a [0, 1] fundamental mode, it is desirable to select a [1,n] higher order mode.

If n is chosen to be 4, i.e. the [1, 4] mode with lm'=1.0479 cm, is selected, then the value for the middle term of equation (1) becomes 2lm'=2.0958 cm. While this value for a higher order maximum is not exactly equal to the value (2.0023 cm) for a fundamental minimum, they are very close. It follows that, if the load depth d is selected within the range of approximately 2.0 to 2.1 cm, the ratio of power embodied in the higher order mode [1,4] to that embodied in the fundamental mode [1,1]will be significantly increased over that obtained with a randomly chosen depth. Since a high (but not necessarily the theoretically highest) value for this ratio will represent a significant improvement, and, since there will likely in practice be some unevenness to the top surface of the load and hence some nonuniformity to its depth across its lateral dimensions, the preferred range of 2.0 to 2.1 cm applicable in these circumstances can be extended to a range of approximately 1.9 to 2.2 cm, while still obtaining benefits from the invention.

The values for lm and lm' will be determined before making a final choice for the ideal value of d, and the acceptable range of values straddling such ideal value, since lm and lm' will vary with the values of e' and e'' for each particular load. Nevertheless., it has been found experimentally that, for a large number of typical food loads, a value for d of approximately 2.0 to 2.1 cm affords substantially improved results (in terms of heating uniformity) over loads of other depths.

Figure 10:
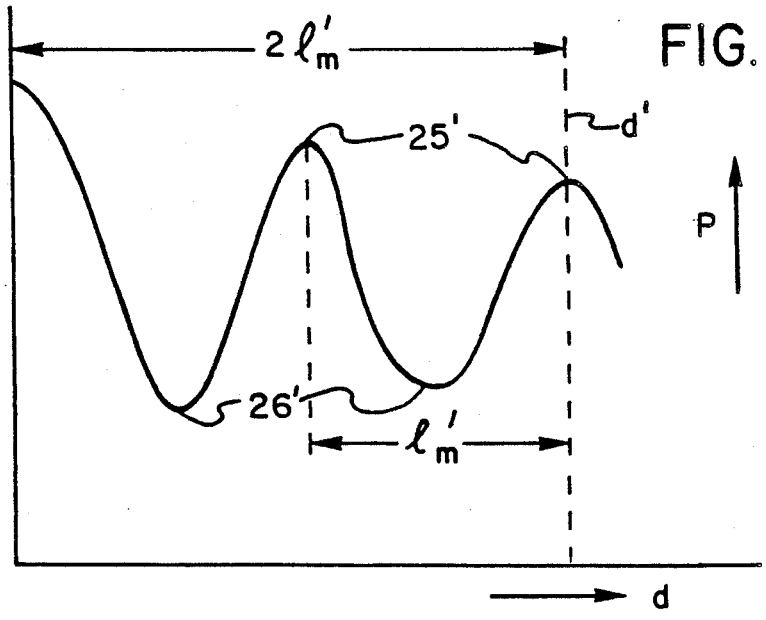
Figure 11:
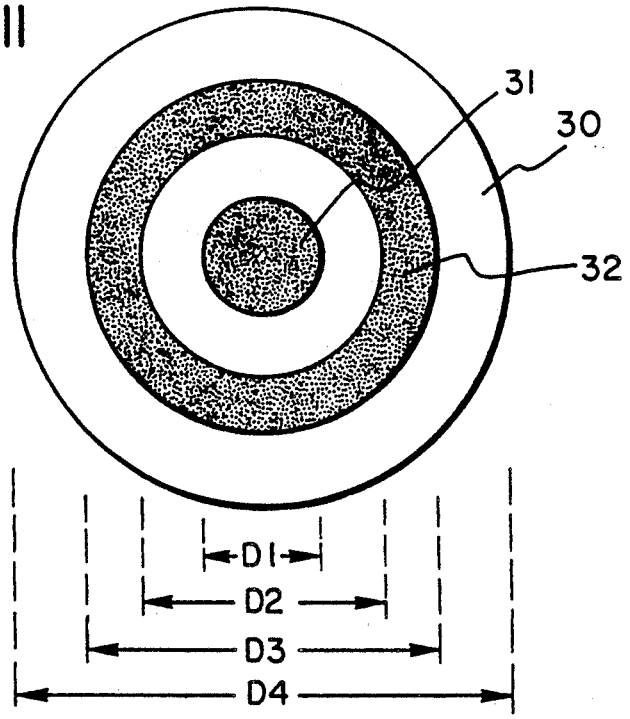
FIGS. 11 and 12 are respectively a plan and a perspective view of a container fitted with a lid for generating higher order modes.
Figure 12:
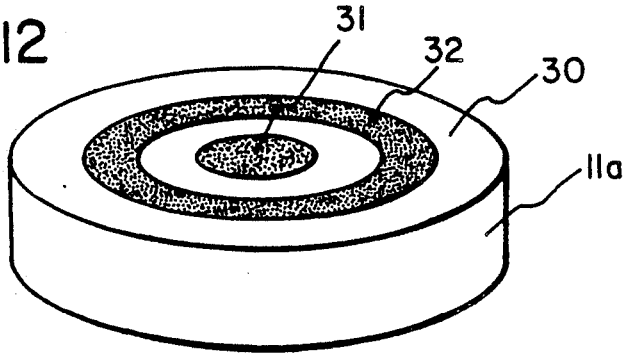

One way of creating the [1,4] mode having the characteristic shown in FIG. 10, is illustrated in FIGS. 11 and 12 which show a microwave-transparent lid 30 for the container 11*a*, the lid 30 having an inner circle 31 of foil (microwave-reflective material) centrally located thereon, and an annulus 32 of foil symmetrically surrounding the central circle 31. To achieve the [1,4] mode the diameters for a 10 cm container should be approximately

| | |
|---|---|
| D4 (the inside diameter of the container and hence the outside diameter of the load) | = 10 cm |
| D3 (the outside diameter of the foil annulus 32) | = 7.64 cm |
| D2 (the inside diameter of the foil annulus 32) | = 5.27 cm |
| D1 (the diameter of the foil circle 31) | = 2.88 cm |

Figure 13:
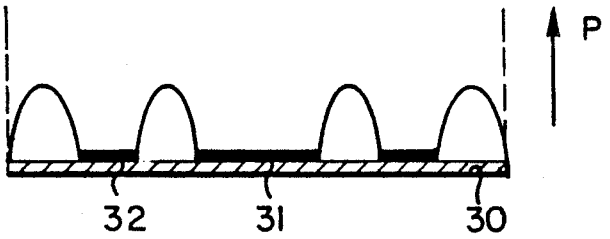
FIG. 13 depicts an electrical field that exists in the construction of FIGS. 11 and 12.

The cross-sectional energy profile of the [1,4] mode in the structure of FIGS. 11 and 12 is shown in FIG. 13.

Figure 14:
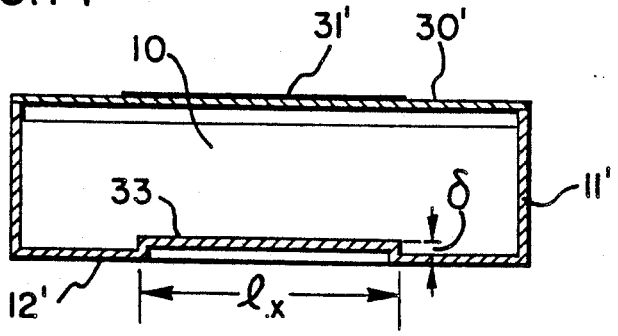
FIG. 14 is a sectional view of an alternative construction.

As an alternative, a more general version of equation (2) can be employed, namely $$d = \delta + K' l_m' = \frac{(2K+1)}{2} l_m \qquad (2A)$$

where δ is the height of a step 33 in the bottom 12' of a container 11' (FIG. 14). While in FIGS. 9 through 13, the container has been assumed to have a flat, unstepped bottom 12 (FIG. 2), resulting in a constant depth d of the load 10 throughout, i.e. δ=0, which arrangement simplifies the manufacture of the container, use of the step 33 affords a wider choice of higher order mode to satisfy equation (1A). For example, if, with the FIG. 14 construction, the [1,2] mode is selected as the higher order mode, the value of 2lm' becomes 1.6780 cm, and hence δ should be equal to 2.0023−1.6780=0.3243 cm. In practice, values of d= approximately 2.0 cm and δ= approximately 0.3 can be chosen.

Figure 15:
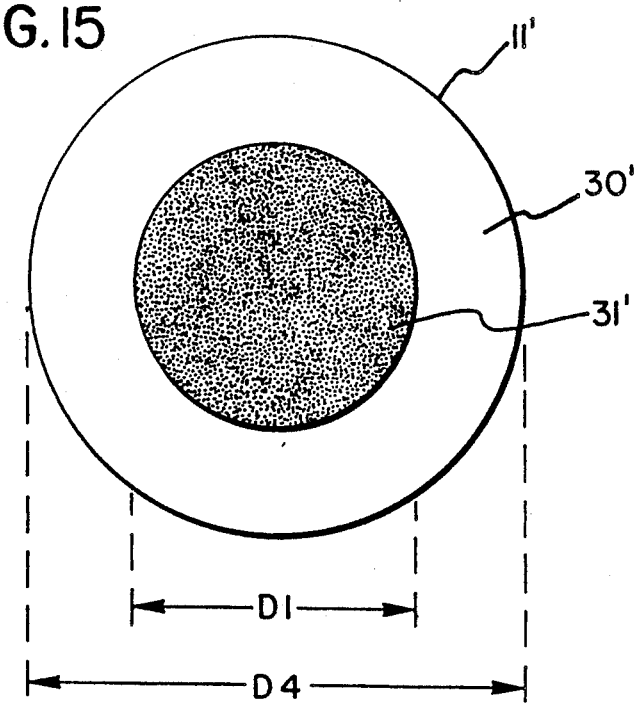
FIG. 15 is a plan view of FIG. 14.

To achieve the [1,2] mode the structure of the lid 30' shown in FIGS. 14 and 15 can be used, with the diameter D1 of a foil circle 31' being 5.46 cm, assuming that the diameter D4 of the load remains at 10 cm. The annulus 32 is omitted.

This latter construction is essentially that described in FIG. 8 of the Canadian patent cited above.

Alternatively, if its lateral dimensions are properly chosen, i.e. in the present example a diameter of 5.46 cm for the dimension lx, the step 33 can itself be used at least in part to generate the [1,2] higher order mode, in the manner explained in U.S. patent application Ser. No. 044,588 cited above (and its corresponding published European application), in which case the foil circle 31' on the lid could be dispensed with, although there would be an advantage in retaining it, since the assembly would then have similar higher order generating means both top and bottom and the result would be a more uniform distribution of the energy of such mode in the vertical direction.

Figure 9:
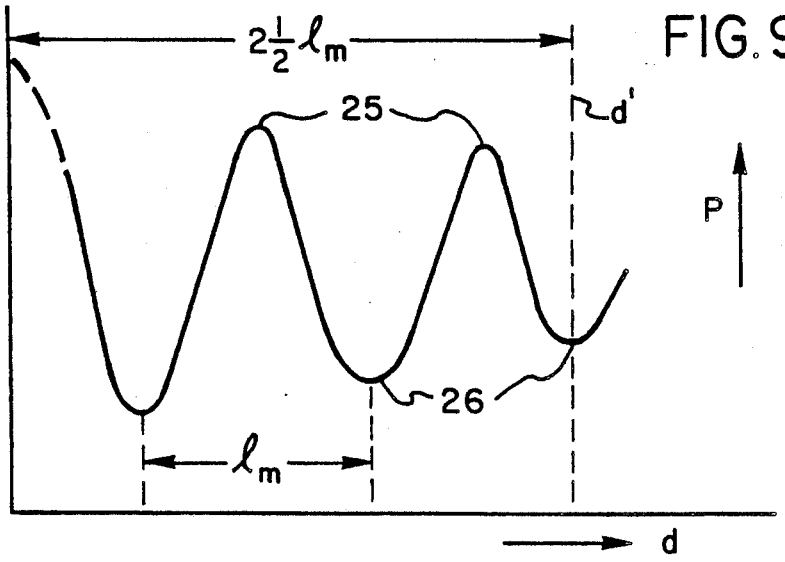
FIGS. 9 and 10 respectively depict in an idealized form characteristics of fundamental and higher order modes of microwave energy in a circular container having a microwave-transparent side wall.

FIGS. 9 and 10, on which equations (2) and (2A) are based, show conditions in a microwave-transparent container. If, on the other hand, the bottom 12 of the container is electrically conductive (e.g. metallic or containing a metallic layer) the fundamental mode would have the characteristics shown in FIG. 16, and the higher order mode would have the characteristics shown in FIG. 17. In the case of a container with a semi-microwave-transparent wall, the conditions will be intermediate between those of FIGS. 9 and 10 and those of FIGS. 16 and 17.

Changes of composition of the container bottom 12 can be visualized as giving rise to displacement of the maxima and minima of power absorption in the vertical axis shown in FIGS. 9 and 10. When electric fields with components of equal magnitude are applied to the upper and lower surfaces of a load 10 placed in a container having a microwave-transparent bottom 12, then for a container depth d, the term Γ and the factor D(z) of equation (1b) may be written as:

$$\Gamma = e^{-\rho d}, \text{ and}$$

$$|D(z)|^2 = 2e^{-\alpha d}\cdot[\cosh 2\alpha(z-\tfrac{1}{2}d) \pm \cos 2\beta(z-\tfrac{1}{2}d)] \quad (1d)$$

(microwave-transparent bottom)

For a container with an electrically conductive bottom 12 (e.g. a container made of aluminum foil), the components of the electric field directed tangentially to the inner surface of the container bottom will have a negligible intensity at this surface, and hence the term Γ and the factor D(z) may be taken as:

$$\Gamma = e^{-2\rho d}, \text{ and}$$

$$|D(z)|^2 = 2e^{-2\alpha d}\cdot[\cosh 2\alpha(z-d) \pm \cos 2\beta(z-d)] \quad (1e)$$

(electrically conductive bottom)

When the depth d is an integral multiple K of the vertical interval lm given by equation (1c), equations (1d) and (1e) become, respectively:

$$|D(z)|^2 = 2e^{-\alpha Kl_m}\cdot[\cosh 2\alpha(z-\tfrac{1}{2}Kl_m) \pm (-1)^K\cdot\cos 2\beta z],$$

and $$|D(z)|^2 = 2e^{2\alpha Kl_m}\cdot[\cosh 2\alpha(z-Kl_m) \pm \cos 2\beta z]$$

For odd-integral values of K, the sign of the periodic part of these equations changes sign depending on whether the container bottom 12 is microwave-transparent or electrically conducting. A relative minimum of power absorption in the vertical axis of a container having a microwave-transparent bottom will correspond to a relative maximum for a container with an electrically conducting bottom, and vice versa. Hence, the term Γ may be considered notionally as resulting in a phase shift in the location of maxima and minima of power absorption in the vertical axis, this phase shift being determined by the composition of the container bottom, that is, in whether it is electrically conducting, microwave-transparent, or even semi-microwave-transparent.

In the case of a container with a reflective side wall, to achieve substantial coincidence between a fundamental minimum 26a and a higher order maximum 25a at the same value of d, i.e. d', it would be necessary to satisfy the equation $$d = Kl_m = \frac{(2K'+1)}{2}\, l_m' \quad (3)$$

or in the more general case $$d = Kl_m = \frac{(2K'+1)}{2}\, l_m' + \delta \quad (3A)$$

Figure 16:
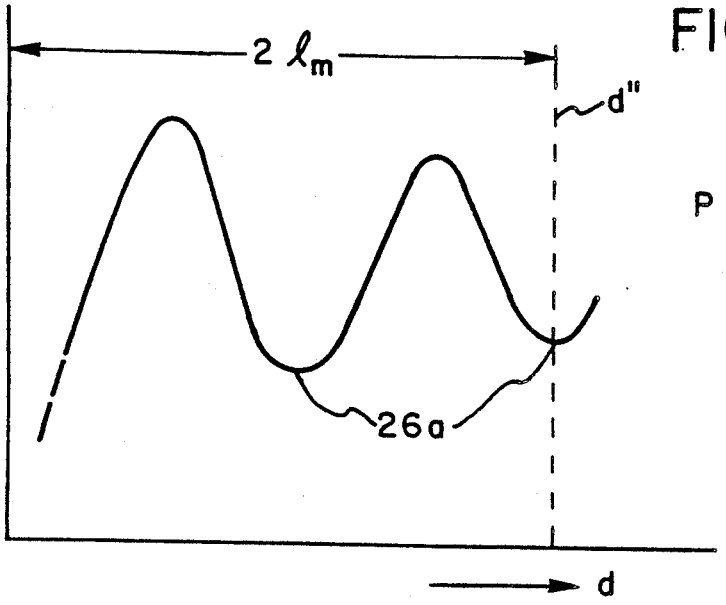
FIGS. 16 and 17 respectively depict in an idealized form characteristics of fundamental and higher order modes of microwave energy in a circular container having a reflective side wall.
Figure 17:
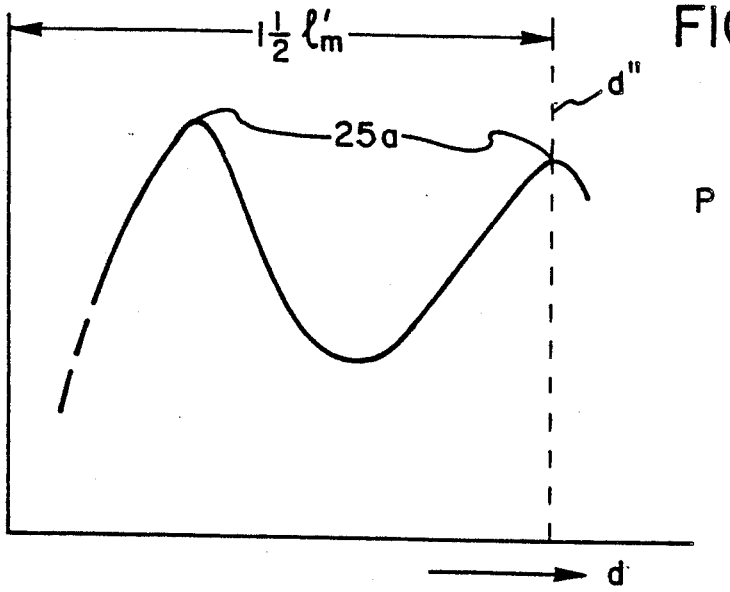

FIGS. 16 and 17 assume that K is taken as 2' and K' as 1, although these values can be chosen to best fit the values of lm and lm' available for the selected fundamental and higher order modes.

Comparing equations (2A) and (3A) there will be seen to be a generic equation covering both situations, namely $$d = \delta + Al_1 = \frac{(2B+1)}{2}\, l_2 \quad (4)$$

where δ is the height of the step (zero in a flat bottom container),

A and B are positive integers, $l_1$ is the spacing between minima (and between maxima) of one of (i) the fundamental mode selected, and (ii) the higher order mode selected, and $l_2$ is the spacing between minima (and between maxima) of the other of such selected modes. When the side wall is at least partial microwave-transparent , $l_1$is lm' (higher order mode spacing) and $l_2$ is lm (fundamental mode spacing), while, when the side wall is reflective, $l_1$ is lm and $l_2$ is lm'.

While the step 33 has been shown in FIG. 14 as projecting into the container 11', which for manufacturing purposes will normally be the more convenient arrangement, as explained in U.S. application Ser. No. 044,588 cited above, such step can achieve a similar higher order mode generating effect when projecting out of the container, or both into and out of the container simultaneously. It follows that, in addition to being zero (flat bottomed container), the value of δ can be either positive or negative, both to accommodate either such alternative direction of projection of the step (or steps) 33, and to locate a positive value of δ on the appropriate side of equation (4), i.e. to render equation (4) more clearly a generalised version of equations (2A) and (3A).

The description so far has assumed a container with a vertical side wall. In practice, the side wall will often have some upward and outward slope, which will mean that the diameter of the top surface of the load will be greater than that of its bottom surface. The foregoing calculations will nevertheless be sufficiently accurate in practice to provide a significant improvement in heating uniformity, even though equation (4) may not always be fully satisfied at all levels in the load.

In fact, equation (4) represents an ideal situation for which it is not always necessary in practice to aim fully. Equation (4) represents the situation in which the selected higher order mode is theoretically at maximum power while the selected fundamental mode is theoretically at minimum power. It is important to realise that the former criterion is more important than the latter criterion. In other words, provided the higher order mode power is at or near its maximum, ensuring that the fundamental mode power is at or near its minimum is less critical. While keeping the fundamental mode power at a minimum theoretically affords an optimum value of the ratio of the intensity of the higher order mode relative to the intensity of the fundamental mode, there are circumstances in which a less than optimum such value can be tolerated. Hence coincidence of the minima 26 and 26a on the depth related curves (FIGS. 9 and 16) for the fundamental mode with the maxima 25' and 25a on the corresponding curves (FIGS. 10 and 17) for the chosen higher order mode, i.e. full satisfaction of equation (4), is not an essential feature of the present invention in its broadest scope What is essential is that the depth d be so chosen that the higher order mode power is at or near one of its maxima 25' or 25a.

Figure 18:
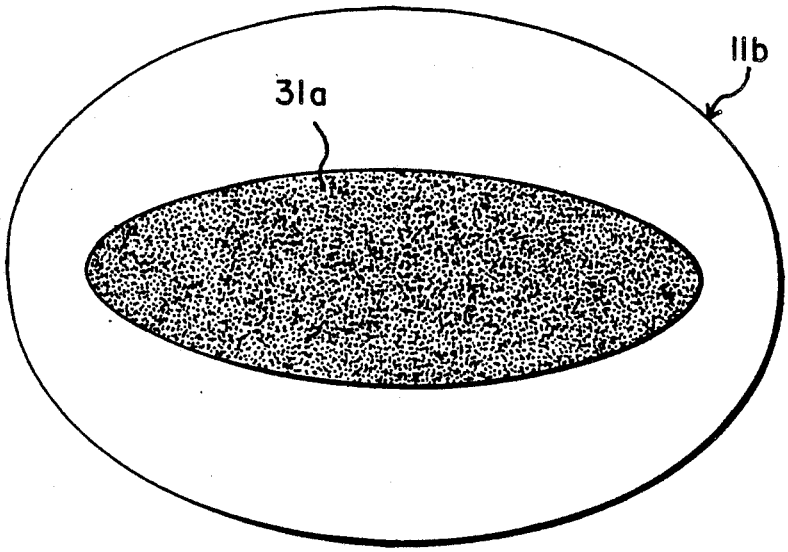
FIGS. 18 and 19 are plan views of alternative constructions.

Essentially the same practical considerations as for a circular container also apply to the elliptical container 11b (FIG. 18) which exhibits similar modes. Indeed, since a circle is merely a special form of an ellipse, i.e. with zero eccentricity, the term "elliptical" will be used in this specification and the claims that follow to include a circle. If an elliptical container with a positive eccentricity has a sloping side wall, the construction should ideally be such that the smaller ellipse defined by the bottom surface of the load should be confocal or conformal with the larger ellipse defined by the top surface of the load. Also, if structures such as those shown in FIGS. 11, 14 and 15 are used to generate a higher order mode in an elliptical container with a positive eccentricity, the foil portion(s) e.g. 31a, or step(s) of these structures should have inner and outer edges that are preferably confocal or at least conformal with the load surface(s).

If the container is rectangular so that rectangular modes are involved, the calculations for the values of (m and lm' are different from those given above.

Specifically, for fundamental modes in a square container the value for k is $$k^2 = \frac{\pi^2}{L^2}(m^2 + n^2) \tag{5}$$

where L is the length of each side, and the terms m and n originate as separation constants in the x and y coordinates and determine the order of the mode (taken as [m, n]).

If L is taken as equal to 11 cm, the following values of lm apply:

[0, 1] lm=0.7882 cm
[1, 0] lm=0.7882 cm
[1, 1] lm=0.7902 cm

For higher order modes, the following values for lm' apply:

[2, 0] lm'=0.7943 cm
[0, 2] lm'=0.7943 cm
[2, 1] lm'=0.7963 cm
[1, 2] lm'=0.7963 cm
[2, 2] lm'=0.8026 cm
[3, 0] lm'=0.8047 cm
[0, 3] mm'=0.8047 cm
[3, 3] lm'=0.8246 cm

Figure 19:
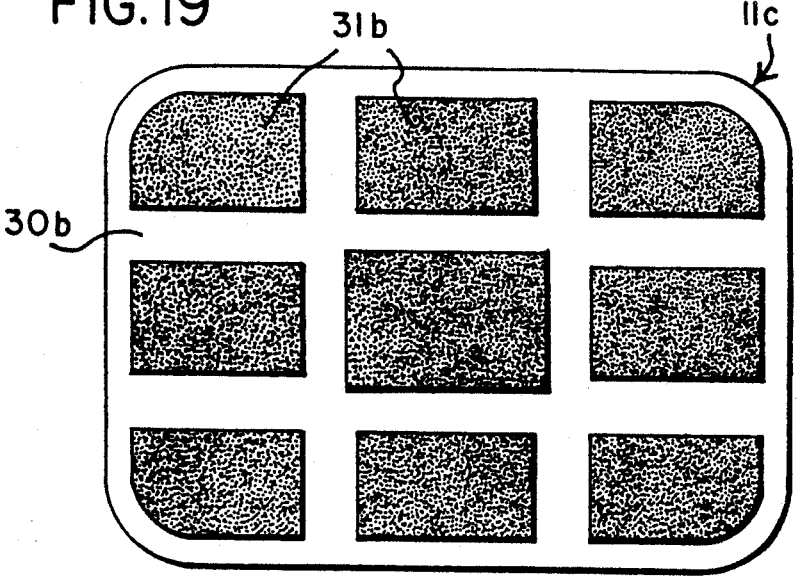

In a rectangular container, if a structure such as shown in FIG. 10A or 10B of the Canadian patent cited above is employed to generate the higher order mode, the structure of FIG. 10B of such prior patent (foil islands in an area of microwave-transparent material) would generate modes [0, 3], [3, 0] and [3, 3], while the structure of FIG. 10A of such prior patent (apertures in a sheet of foil) would generate the [3, 3] mode. FIG. 19 shows an example of foil islands 31b in microwave-transparent material 30b forming the lid of the generally rectangular container 11c.

The above considerations, including equation (4), will be applicable to a rectangular container, provided that the value for k is given by $$k^2 = \pi^2[(m/L_x)^2 + (n/L_y)^2] \tag{6}$$

where Lx and Ly define the rectangular dimensions.

As will be clear from. the foregoing description, the present invention can employ any structure by which at least one higher order mode is generated (or enhanced). In the claims that follow the term "generated" is intended to include the enhancing of existing modes. While the foregoing description has assumed that the higher order mode generating means will be embodied in the container (lid, bottom or both), it is possible to use an unmodified container with separate higher order mode generating means, such as described in the Canadian patent and various Canadian patent applications cited above.

An important use of the present invention is believed to reside in the manufacture of products that consist of disposable containers containing food, usually in the frozen state. However, the advantages of the invention can also be taken advantage of in the manufacture of reusable cookware vessels. Such a vessel would be accompanied by instructions to the user regarding the optimum depth to which it should be filled to achieve the most uniform heating. Such instructions may take the form of a separate chart (different depths for different foods) or of one or more marks inscribed on the wall structure of the vessel and indicating optimum fill depths.

It will be understood that the various references to "vertical", "upper", "lower", "depth" and other words suggesting a particular orientation of the product are used for convenience only and that the interactions of the container and its load with the microwave energy are not specific to any particular inclination or orientation.

We claim:

1. A product comprising a container and a load located therein or thereon for heating by microwave energy, said product in combination with means for generating at least one mode of said energy of an order higher than a fundamental mode determined by boundary conditions defined by lateral dimensions of at least one of said container and said load, wherein the depth of the load in the container is such that, upon irradiation of the product with microwave energy, the power absorbed by the load from said higher order mode is at or near a maximum value relative to the fundamental mode.

2. A product according to claim 1, wherein said container embodies said means for generating at least one higher order mode.

3. A product according to claim 2, wherein said depth is such that the power absorbed by the load from said fundamental mode is less than the power absorbed by the load from said higher order mode.

4. A product according to claim 3, wherein said depth is such that the power absorbed by the load from said fundamental mode is at or near a minimum value.

5. A product according to claim 4, wherein the load is a food load consisting mainly of water, the container is elliptical including circular, the fundamental mode is the (0.1) mode, and the higher order mode is the (1, 4) mode.

6. A product according to claim 5, wherein said depth is in the range of approximately 1.9 to 2.2 cm.

7. A product according to claim 6, wherein said depth is in the range of approximately 2.0 to 2.1 cm.

8. A product according to claim 4, wherein the load is a food load consisting mainly of water, the container is elliptical including circular and has a substantially centrally located step in a bottom surface thereof, the fundamental mode is the (1, 1) mode, the higher order mode is the (1, 2) mode, the depth of the load in the portion of the container not over said step is approximately 2 cm and the height of the step is approximately 0.3 cm.

9. A product according to claim 8, wherein said step constitutes at least part of said means for generating the higher order mode.

10. A product according to claim 4, wherein the load is a food load consisting mainly of water, the container is generally rectangular, the fundamental mode is the (1, 1) mode and the higher order modes is selected from the modes (0, 3), (3, 0) and (3, 3).

11. A product according to claim 4, wherein said depth (d) is substantially uniform throughout the lateral dimensions of the load and is given by $$d = Al_1 = \frac{(2B+1)}{2} l_2$$

wherein A and B are positive integers, $l_1$ is the spacing between minima and between maxima of one of (i) the fundamental mode selected, and (ii) the higher order mode selected, and $l_2$ is the spacing between minima and between maxima of the other of such selected modes.

12. A product according to claim 11, wherein the container has a side wall structure that is at least partially microwave-transparent, and wherein said depth (d) is given by $$d = K' l_m' = \frac{(2K+1)}{2} l_m$$

wherein K and K' are positive integers, $l_m$ is the spacing between power minima of the fundamental mode, and $l_m'$ is the spacing between power maxima of the higher order mode.

13. A product according to claim 11, wherein the container has a side wall structure that is microwave-reflective, and said depth (d) is given by $$d = Kl_m = \frac{(2K'+1)}{2} l_m'$$

wherein K and K' are positive integers, $l_m$ is the spacing between power minima of the fundamental mode, and $l_m'$ is the spacing between power maxima of the higher order mode.

14. A product according to claim 4, wherein the container has a substantially centrally located step of height δ in a bottom surface thereof, the upper surface of the load being substantially uniform throughout the container, whereby the depth (d) of the load in the portion of the container not over said step is modified by the height δ over said step, said depth being given by $$d = \delta + Al_1 = \frac{(2B+1)}{2} l_2$$

wherein A and B are positive integers, $l_1$ is the spacing between minima and between maxima of one of (i) the fundamental mode selected, and (ii) the higher order mode selected, and $l_2$ is the spacing between minima (and between maxima) of the other of such selected modes.

15. A product according to claim 14, wherein the container has a side wall structure that is at least partially microwave-transparent side wall, said depth (d) being given by $$d = \delta + K' l_m' = \frac{(2K+1)}{2} l_m$$

wherein K and K' are positive integers, $l_m$ is the spacing between power minima of the fundamental mode, and is the spacing between power maxima of the higher order mode.

16. A product according to claim 14, wherein the container has a side wall structure that is microwave-reflective, said depth (d) being given by $$d = Kl_m = \frac{(2K'+1)}{2} l_m' + \delta$$

wherein K and K' are positive integers, $l_m$ is the spacing between power minima of the fundamental mode, and $l_m'$ is the spacing between power maxima of the higher order mode.

17. A product according to claim 16 wherein said step constitutes at least part of said means for generating at least one higher order mode.

18. An assembly comprising (a) a container for mounting a load in a microwave oven, said container including means for generating at least one mode of microwave energy of an order higher than a fundamental mode determined by boundary conditions defined by lateral dimensions of at least one of said container and said load, and (b) means for indicating a depth of the load in the container such that the power absorbed by the load from said higher order mode will be at or near a maximum value relative to the fundamental mode.

19. An assembly according to claim 18, wherein said indicating means comprises a mark inscribed on the container.

20. An assembly according to claim 18, wherein said indicating means comprise a chart for use with the container.

21. An assembly according to claim 18, wherein said container includes means for generating said higher order mode.

22. In a method of heating a load in a container by microwave energy, lateral dimensions of at least one of said container and said load defining boundary conditions that determine a fundamental mode of said energy, the steps of (a) generating at least one mode of said energy of an order higher than said fundamental mode, and (b) so controlling the depth of said load that the power absorbed by the load from said higher order mode is at or near a maximum value relative to the fundamental mode.

23. A method according to claim 22, wherein said depth is such that the power absorbed by the load from said fundamental mode is less than the power absorbed by the load from said higher order mode.

24. A method according to claim 22, wherein said depth is such that the power absorbed by the load from said fundamental mode is at or near a minimum.

* * * * *

UNITED STATES PATENT AND TRADEMARK OFFICE

CERTIFICATE OF CORRECTION

PATENT NO. : 4,990,735

DATED : February 5, 1991

INVENTOR(S) : Claude P. Lorenson, Bryant C. Hewitt, Richard Keefer and Melville D. Ball It is certified that error appears in the above-identified patent and that said Letters Patent is hereby corrected as shown below:

Title Page item [57]:
Abstract, line 8, change "of" (second occurrence) to --or--.

Column 5, line 41, change "$\bar{E}$" to --$\bar{E}$*--; line 66, change "u and v" to --$\hat{u}$ and $\hat{v}$--. Column 6, line 1, change "z" to --$\hat{z}$--; line 3, change "u and v" to --$\hat{u}$ and $\hat{v}$--; lines 9-12 (in the table), change

| "u | v | u | v | | --$\hat{u}$ | $\hat{v}$ | u | v |
|---|---|---|---|---|---|---|---|---|
| $\rho$ | $\phi$ | $\rho$ | $\phi$ | to | $\hat{\rho}$ | $\hat{\phi}$ | $\rho$ | $\phi$ |
| $\xi$ | $\eta$ | $\xi$ | $\eta$ | | $\xi$ | $\hat{\eta}$ | $\xi$ | $\eta$ |
| $\chi$ | $\gamma$ | $\chi$ | $\gamma$" | | $\hat{x}$ | $\hat{y}$ | x | y--; |

line 14, change "$\sigma$" to --$\phi$--; line 28, change "y" to --$\hat{y}$--; line 30, change "u" to --$\hat{u}$--; line 33, change "v" to --$\hat{v}$--;

line 48, change "E" to --$\bar{E}$--. Column 7, line 5, change "$\rho_e$" to --$\sigma_e$--; line 63, change "z." to --z).--. Column 9, line 1, change "$\rho$" to --$\hat{\rho}$--. Column 10, line 11, delete "15"; line 16, delete "20". Column 14, line 5, change "2'" to --2,--; line 32, change "application Ser. No. 044,588" to --patent No. 4,831,224--. Column 15, line 30, change "(m" to --lm--; line 56, change "mm'" to --lm'--. Column 18, line 2,change "(and between maxima)" to --and between maxima--; line 13, after "and" insert --lm'--.

Signed and Sealed this

Eleventh Day of August, 1992

*Attest:*

*Attesting Officer*

DOUGLAS B. COMER

*Acting Commissioner of Patents and Trademarks*